United States Patent [19]

Anton

[11] 4,327,648

[45] May 4, 1982

[54] FUNICULAR RAILWAY CAR CABIN

[76] Inventor: Frech Anton, Wengistrasse 1, 4600 Olten, Switzerland

[21] Appl. No.: 38,881

[22] Filed: May 14, 1979

[51] Int. Cl.[3] ..... B61B 9/00; B61D 13/00; B61D 17/06; B61D 17/08

[52] U.S. Cl. ..... 105/150; 52/45; 52/282; 104/93; 105/329 S; 105/401; 105/402; 105/422; 403/231

[58] Field of Search ..... 29/526 R; 52/45, 264, 52/265, 282; 104/89, 93, 112; 105/148, 150, 329 R, 329 S, 396, 397, 401, 402, 422; 403/231

[56] References Cited

U.S. PATENT DOCUMENTS

| | | | |
|---|---|---|---|
| Re. 11,023 | 8/1889 | Smith | 105/401 |
| 953,352 | 3/1910 | Smith | 105/401 X |
| 2,489,670 | 11/1949 | Powell, Jr. | 52/282 X |
| 2,504,658 | 4/1950 | Theriault | 105/397 |
| 3,292,323 | 12/1966 | Hagan | 52/282 X |
| 3,606,843 | 9/1971 | Adams et al. | 105/397 |
| 3,736,035 | 5/1973 | Brown et al. | 52/282 X |
| 3,971,324 | 7/1976 | Frech | 105/150 X |

FOREIGN PATENT DOCUMENTS

| | | | |
|---|---|---|---|
| 165150 | 9/1915 | Canada . | |
| 608014 | 11/1960 | Canada . | |
| 967324 | 5/1975 | Canada . | |
| 569603 | 11/1975 | Switzerland | 105/150 |

*Primary Examiner*—Joseph F. Peters, Jr.
*Assistant Examiner*—Howard Beltran
*Attorney, Agent, or Firm*—Werner W. Kleeman

[57] ABSTRACT

A cabin for a funicular railway comprises a floor, two lateral walls facing each other, one of which is provided with a door opening, two end-walls, and a roof. All of these parts are united detachably by means of bolts, so that the cabin may be transported in the knocked-down condition, and may be subsequently assembled by bolting. The side and upper edges of the lateral walls consist of light-metal bars, the ends of which are welded together in pairs. The roof is provided with four bars welded together in pairs and together forming a roof-frame, two of these bars being welded to the bars forming the upper edges of the lateral walls. The end-walls are edged at the bottom and sides with bars which are bolted to the bars of the lateral walls and are riveted to the plates. The upper parts of the end-walls consist of transparent sheets, secured detachably, by means of resilient strips to parts of the end-walls, of the two lateral walls, and of the roof.

10 Claims, 7 Drawing Figures

FUNICULAR RAILWAY CAR CABIN

The invention relates to a cabin for a funicular railway, comprising a floor, two opposing lateral walls, at least one of which has a door opening, two opposing end-walls, and a roof.

In existing cabins of this kind, the shell of the cabin, apart from the windows and doors, consists of sheet metal and bars, individual parts, especially those subjected to heavy stresses, being welded together. Such cabins are normally made in the manufacturer's plant. During transportation from the plant, they occupy a relatively large amount of room, and transportation costs are therefore relatively high, especially over long distances. Now it would, of course, also be possible to weld the parts of the cabin together in situ, i.e. in the vicinity of the funicular railway, but this would involve transporting welding and auxiliary equipment, and welders, to the location of the funicular railway, which would also have a detrimental effect upon the costs, all the more so since the parts of the cabin to be welded are of aluminum and the welding of aluminum is relatively demanding work requiring special equipment and specially trained personnel.

It is therefore the purpose of the invention to provide a cabin, the component parts of which may be transported compactly to the site of the funicular where they can be assembled by personnel without any special training.

This purpose may be achieved by means of a cabin of the type characterized by a construction in accordance with the present invention which includes a cabin for a funicular railway, the said cabin comprising a floor, two lateral walls facing each other, at least one of which has a door opening, two end-walls facing each other, and a roof, characterized in that the said floor, walls and roof are connected detachably to each other, at least a part of their edges being secured together by fastening means.

The design according to the invention makes it possible to transport the cabin in the dismantled condition to the point of use, whereby the floors, walls, and roofs of a plurality of cabin are stacked for transportation in containers.

The edges of the cabin comprises sections at the floor and walls, or at one wall and the roof which are arranged in pairs and bolted together. One section of a pair is provided with a longitudinal rib adapted to fit into a complementary longitudinal groove in the other section. This provides highly stable connections, in which the bolts are scarcely stressed in shear by the forces in the vertical direction, and in the direction of travel, arising when the cabin is in operation.

It is desirable for the longitudinal grooves to taper towards their bases. The longitudinal ribs and grooves may be trapezoidal in cross section, for example, in which case they centre themselves as the cabin is assembled. This speeds up the assembly and eliminates any problems.

The object of the invention will be explained hereinafter in conjunction with the example of embodiment illustrated in the drawing attached hereto, wherein.

Figure 1:
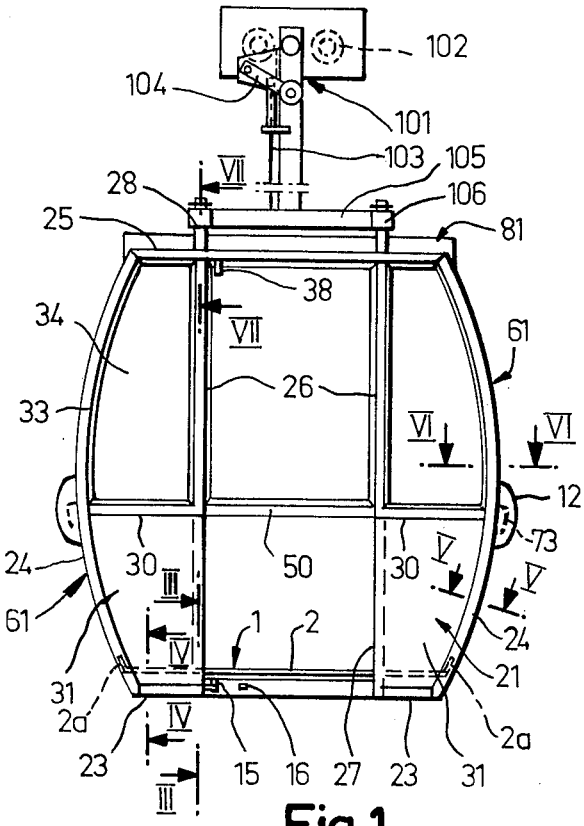
FIG. 1 is an elevation showing the lateral wall of the cabin comprising the door opening, the door having been omitted.
Figure 2:
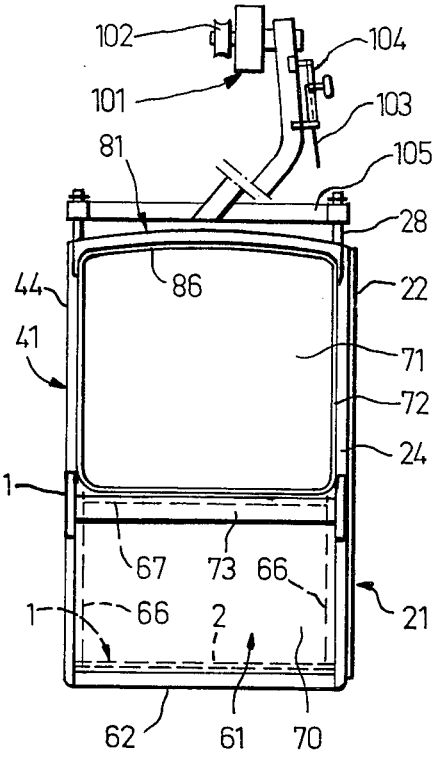
FIG. 2 is an elevation showing an end-wall of the cabin illustrated in FIG. 1.

FIGS. 1 and 2 illustrate a cabin for a funicular railway, the said cabin being in the form of a box comprising a floor 1, a flat vertical lateral wall 21 equipped with an opening 27 for a door 22 shown in FIG. 2, a flat vertical lateral wall 41, two curved end-walls 61, and a roof 81. Lateral walls 21, 41 run parallel with the direction of travel. Arranged above roof 81 is a suspension 101 comprising rollers 102 by means of which the cabin may be suspended from a cable. The cabin is provided with two seats, not shown, the backs thereof running along end-walls 61.

Floor 1 has a member 2 forming the internal floor of the cabin and equipped with upwardly bent tabs 2*a* which are shown particularly clearly in FIGS. 3 and 4 and are bolted to parts to be described in greater detail hereinafter. Located under floor member 2, in the vicinity of door opening 27, is a rectangular, horizontally arranged frame 11 which consists of two U-sections 12 running at right angles to lateral walls 21, 41, and of two cross-sectionally rectangular plates 13 welded to the said U-sections and running parallel with lateral walls 21, 41. Frame 11 is secured to floor member 2 by means of bolts, not shown, or by some other means. The area defined by frame 11 is closed off at the bottom by an outer floor member which is not visible in the drawing. Thus frame 11, in conjunction with floor member 2 and the invisible external floor member, encloses a cavity. This cavity accommodates a door-actuating device such as that described in Swiss Pat. No. 569,603 and corresponding U.S. Pat. No. 3,971,324. The said door-actuating device is connected, by a Bowden cable 103, to a sensing lever 104 fitted with a roller, the said lever being pivoted, as the cabin enters and leaves the station, by an appropriate control rail. Furthermore, a pivot arm 16 extends through an aperture in the frame and is connected to the door by means of a threaded pivot pin.

The bottom of lateral wall 21 is provided, on each side of door opening 27, with a hollow horizontal section 23, the longitudinal opening therein being defined by three section-walls 23*a*, 23*b*, 23*c*. Walls 23*a*, 23*b* are formed by legs forming a right angle with each other. The third wall 23*c* is formed by an arc uniting the two longitudinal edges, facing away from each other, of walls 23*a*, 23*b* and extending over a central angle of 90°. Wall 23*b* is provided with a longitudinal groove 23*d*, the bottom of which runs parallel with the plane formed by lateral wall 21, the sides of the said groove tapering towards the bottom and the said groove being thus trapezoidal in shape. Leg 23*b* is thickened near the bottom of the groove and has a threaded bore 23*h*, as shown in FIG. 4, at the end remote from the door opening. A flange 23*e*, running tangentially to arcuate section-wall 23*c*, projects from the outside of horizontal section-wall 23*a* remote from section-wall 23*b*, the said flange being provided with through-holes 23*f* for rivets 32.

Lateral wall 21 also comprises two bars 24 running upwardly and constituting its lateral edges, the lower ends of the said bars being welded to bars 23, and forming curves running at right angles to lateral wall 21. As may be gathered from FIG. 5, the lower parts of bars 24 have the same cross-sectional shape and dimensions as bars 24. They thus have three walls 24*a*, 24*b*, 24*c*, wall 24*b* being provided with a longitudinal groove 24*d*. Moreover, where walls 24*a*, 24*b* come together, there is an outwardly projecting flange 24*e* tangential to wall 24*c*.

Figure 6:
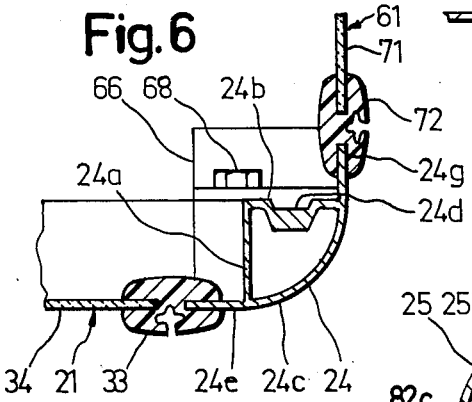
FIG. 6 is a section along the line VI—VI in FIG. 1.

The cross-sectional shape of the upper parts of bars 24 is shown in FIG. 6. In addition to the sections already mentioned, there is a flange 24*g* which projects, tangentially to wall 24*c*, beyond wall 24*b*. At the point where flanges 24*e*, 24*g* come together with the hollow part of bar 24, flanges 24*g*, 24*e* are provided with longitudinal throats on the side facing the crest formed by walls 24*a*, 24*b*, so that they may be relatively easily separated. Bar 24 may therefore be produced from a section having the cross-sectional shape illustrated in FIG. 6 from which flange 24*g* is then separated to form the lower part.

Figure 7:
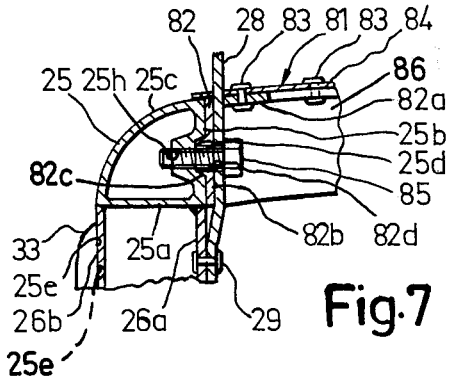
FIG. 7 is a section along the line VII—VII in FIG. 1.

Welded to the upper end of bar 24 is a hollow bar 25 running horizontally. The cross-sectional shape of bar 25 is shown in FIG. 7. It comprises two walls 25*a*, 25*b*, forming a right angle with each other, and an arcuate wall 25*c*. These walls are of the same shape and dimensions as walls 23*a*, 23*b*, 23*c*. Wall 25*b* has a longitudinal groove 25*d*, the bottom of which runs parallel with the plane of lateral wall 21. However, in the vicinity of door opening 27, bar 25 has no projecting flanges. On the other hand, the two sections of the said flange located at the side of the door opening have downwardly projecting flanges 25*e* corresponding to flange 23*e*.

Thus the outer edges of lateral wall 21 are formed by bars 23, 24, 25, all of which have identical hollow centres. They thus differ only in that they are provided with projecting flanges on one or both sides of the central parts over a portion, or the whole of, their entire length. Bars 23, 24, 25 may therefore be made of the same bar material. The ends of bars 23, 24, 25, 26 are trimmed in such a manner that they can be conveniently butt-welded together.

The sides of door opening 27 are defined by vertical bars 26, the upper ends of which are welded to bars 25 and the lower ends to the ends of each of bars 23. Bars 26 have flanges 26*a*, 26*b* parallel with the plane of lateral wall 21, as shown clearly in FIGS. 3 and 7, which are united by means of a web which runs in such a direction that bars 26 are of Z-shaped cross-section. Bars 23, 24, 25, 26 are made of a light metal, namely an aluminum alloy. Arranged behind each bar 26 is a cross-sectionally rectangular, steel tension rod 28 which is riveted by rivet 29' to leg 26*a* of bar 26. Furthermore, tension rod 28 and leg 26*a* are secured, at the lower end of the bar, by means of bolts 29, to plate 13 of frame 11 pertaining to floor 1.

On each side of door opening 27, lateral wall 21 is provided with a horizontal, light-metal bar 30. One end of each bar 30 is welded to a bar 24, while the other end is welded to a bar 26. Below bar 30, a light-metal plate is secured to each of bars 23, 24, 26, 30, by means of rivets 32 shown in FIGS. 3 and 5. It should be noted, in particular, that plate 31 is riveted to flange 24*e* on bar 24. Located above each of bars 30 is a transparent window 34 made of synthetic material or glass. As may be seen in FIG. 6, window 34 is held by a resilient strip 33 acting as a seal. Each slide of strip 33 has a longitudinal slot accommodating the edges of the window. The outer slot allows strip 33 to be placed upon the flanges of the bars. The section of strip 33 shown in FIG. 6 is fitted to flange 24*e* of bar 24. The upper horizontal section of the strip is placed upon corresponding flange 25*e* of bar 25. The vertical section of strip 33 at the side of the door is placed upon flange 26*b* of bar 26. The lower horizontal section of the said strip is placed upon one flange of bar 30.

Figure 3:
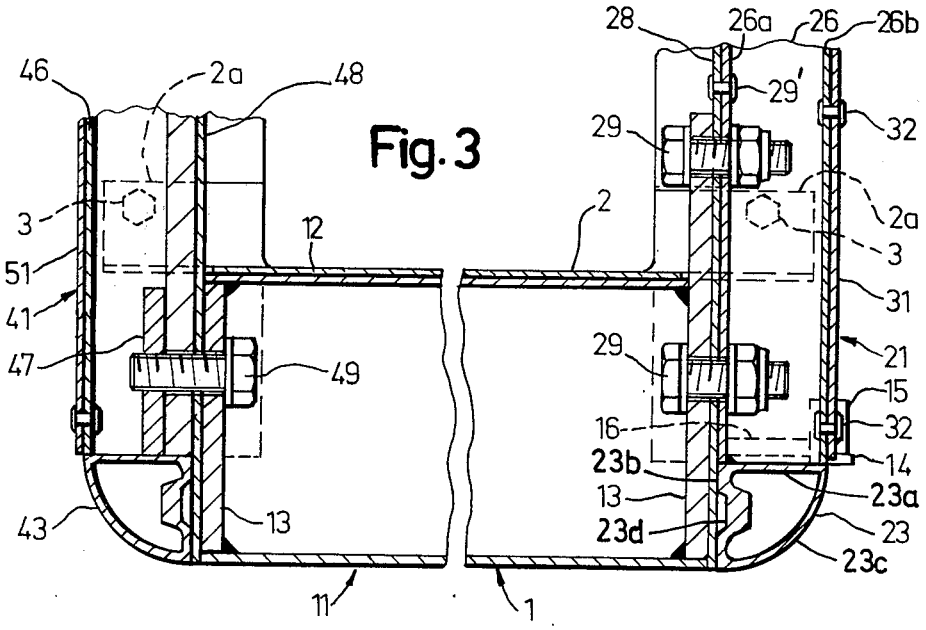
FIG. 3 is a section along the line III—III in FIG. 1, without the door and to an enlarged scale.
Figure 4:
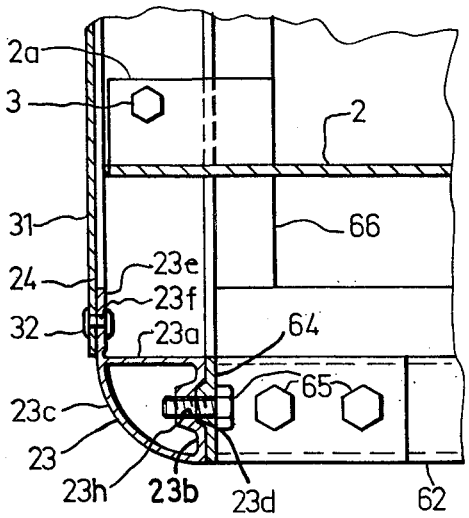
FIG. 4 is a section along the line IV—IV in FIG. 1.

A hinge-pin 15 for the door, not shown in FIGS. 1 to 3, is secured to bar 23 by means of a support 14. Another hinge-pin 38 is secured to bar 25 and is in alignment with lower hinge-pin 15.

Lateral wall 41, facing lateral wall 21, is of identical design. However, instead of the two bars 23, interrupted by the door opening, it has a bar 43 extending over the entire length of the lower edge of the wall. This is visible in FIG. 3 and is of the same cross-sectional shape and dimensions as bar 23. The vertical outer edges of wall 41 are formed by bars 44 which are of the same design as bars 24. Door-free lateral wall 41 has bars 46, instead of vertical Z-shaped bars 26, the said bars 46 being welded at the bottom to bar 43 and, at the top, to a bar corresponding to bar 25, which, in contrast to the said bar 25, also has a downwardly projecting flange in the longitudinal section facing the door opening. Lateral wall 41 also has bars corresponding to bars 30 and a bar 50 in alignment therewith, the ends of which are welded to bars 46. Riveted below the bars corresponding to bars 30 and bar 50 is a plate 51 extending over the entire length of lateral wall 41. Three transparent panes are inserted above the said bars between outer bars 44 and inner bars 46. Bars 43, 44, 46, 50, and the additional, previously mentioned bars of lateral wall 41, are made of a light metal, like the corresponding bars in lateral wall 21. Two steel tension bars 48, of the same design as tension rod 28, are also provided. Vertical bars 46, and tension bars 48, are secured by means of bolts 49, and plate 47 having a threaded hole, to bar 13, running parallel with lateral wall 41, of frame 11 pertaining to floor 1.

As already mentioned, member 2 of floor 1 has upwardly-bent tabs 2*a* which bear against the curved surfaces of walls 24*a* and the corresponding surfaces of bars 44 and are secured thereto by means of bolts 3 already mentioned. This means that floor 1 is secured detachably to lateral walls 21, 41.

Roof 81 has a frame consisting of four light-metal bars welded together at the corners thereof. Two of these bars run horizontally along the upper edges of lateral walls 21, 41. One of these horizontal bars may be seen in FIG. 7 in which it is marked 82 and comprises two legs 82*a*, 82*b*, forming together an angle somewhat larger than 90°. Leg 82*a* faces the identical opposing bar of the roof frame and slopes slightly upwards. Curved roof plate 84 is riveted to leg 82*a*. Leg 82*b* runs vertically downwards from the top of bar 82 and is provided with a cross-sectionally trapezoidal, longitudinal rib 82*c* which is complementary to longitudinal groove 25*d* in bar 25 and projects thereinto. The section of bar 25 adjacent the bottom of the groove is provided with threaded holes 25*h*. In the vicinity of longitudinal rib 82*c*, leg 82*b* is provided with through-passages 82*d*. Roof-frame bars 82 are secured, by means of bolts 25 passing through holes 82*d*, to bar 25 and to the corresponding bar of lateral wall 41.

Below bar 82, each tension bar 28 is slightly offset towards the interior of the cabin, and has a hole for one of bolts 85. Above this bolt, tension bar 28, passes through a slot in leg 82*a* and through a slot in plate 84. The two tension bars pertaining to lateral wall 41 are of the same design and are similarly secured to the roof-frame. Base 105 of suspension 101, consisting of bars welded together, is secured detachably, by means of bolts 106, to the ends of tension bars 28, 48 projecting beyond roof-plate 84.

The other two bars 86 of the roof-frame may be seen in FIG. 2. They are curved upwardly parallel with the roof-plate. Bars 86 have the same cross-sectional shape and dimensions as the section of bar 24 visible in FIG. 6. The hollow part of bar 86 is arranged in the same way as the corresponding part of bar 25 shown in FIG. 7. The upper flange of bar 86 then projects horizontally towards the opposite bar 86. The roof-plate is riveted to the upper flanges of bars 86, while the other flanges of bars 86 project vertically downwards.

Figure 5:
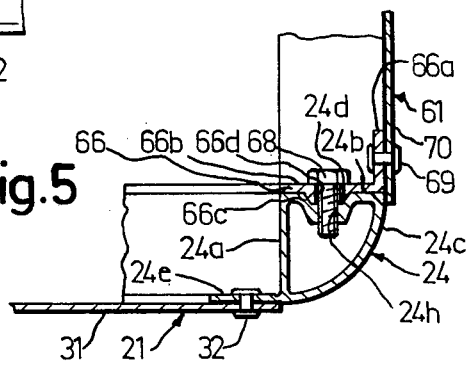
FIG. 5 is a section along the line V—V in FIG. 1.

End-walls 61, which are curved convexly in a vertical section parallel with lateral walls 21, 41 have lower horizontal bars 62 extending over their entire width and cross-sectionally identical with bars 23, 43. Each bar 62 is bolted at one end to one leg of an angle-section 64 arranged internally, the other leg being secured with bolts 65 to one of bars 23. The other end of each bar 62 is similarly bolted, by means of an angle-section, to lower horizontal bar 43 of door-free end wall 41. Each lateral wall 61 also comprises two bars 66, the lower ends of which are each welded to one end of bar 62. Bars 66 are curved and run upwardly along bars 24, 44, but not as far as roof 81, only to about half the height of the cabin. The upper ends of bars 66 are united by a welded bar 67. The cross-sectional shape of bar 66 is shown in FIG. 5. Bar 66 has two legs **66*a*, 66*b* forming a right angle with each other. Leg 66*a* runs parallel with the curved surface of the end-wall, while leg 66*b* rests upon wall 24*b*. Leg 66*b* also has a longitudinal rib 66*c* which is trapezoidal in cross-section and projects into complementary groove 24*d* in bar 24. Bars 24 and 66 are united detachably by means of bolts 68, each of which passes through a hole 66*d* in leg 66*b* and is screwed into a threaded hole 24*h* near the bottom of the groove. Secured by means of rivets 69 to leg 66*a* of bar 66 is a plate 70 which has the same curvature as bars 66**, but in a vertical cross-section, of course.

Arranged above bar 67 is a curved transparent sheet 71, the said sheet being secured by means of a strip 72 of the same cross-sectional shape as strip 33. As may be seen in FIG. 6, sheet 71 is secured detachably to flange **24*g*, by one of its vertical edges, by means of strip 72, the said flange being a part of bar 24 of lateral wall 21. The other vertical edge of the said sheet is similarly secured to bar 44 of lateral wall 41. The lower edge of sheet 71 is secured to bar 67. The upper edge of the said sheet is secured detachably, by means of strip 72, to the downwardly projecting flange of roof-frame bar 86. Below sheet 71, a handle 73 is secured to end wall 61, i.e. to bar 67, the said handle making it easier for an operator to move a cabin while it is in a station. Also secured to the bars forming the edges of the lateral walls running from bottom to top are rubber buffers 121** which serve to absorb shocks applied to the cabin in the direction of travel.

In the case of the cabin described above, therefore, the edges of floor 1 are secured detachably, by means of bolts 3, 29, 49, to flat vertical lateral walls 21, 41. The upper edges of these walls are secured detachably to roof 81 by means of bolts 85. Lateral walls 21, 41 are also secured detachably, by means of bolts 65, 68, to curved lateral walls 61. Transparent sheets 71, pertaining to end-walls 61, are also united detachably, i.e. insertably, by means of resilient strips 72, with lateral walls 21, 41 and roof 81. Suspension 101 is also secured detachably, by means of bolts 106, to the remaining parts of the cabin. The passenger seats, not shown, inside the cabin are also secured with bolts.

A cabin thus designed may be transported, in the knocked-down condition, to the site of the funicular railway for which it is intended; the advantage of this being that it occupies a relatively small transportation space.

As soon as the cabin parts reach the site of the funicular railway, the cabin may be assembled. Floor 1 of the cabin is first set up horizontally on the ground or upon a base. Lateral walls 21, 41 are then set up vertically one after the other and are secured to the said floor with bolts 3, 29, 49. Roof 81 is then placed in position and is bolted to lateral walls 21, 41 with bolts 85. Assembly of each end-wall 61 involves first of all bolting the lower part of the wall, consisting of bars 62, 66, 67, welded together, and plate 70 riveted thereto, by means of angle pieces 64, bolts 65 passing therethrough, and bolts 68, to lateral walls 21, 41. Transparent sheets 71 are now inserted and secured, by means of resilient strip 72, to bar 67 in the lower part of end-wall 61, to bar 86 of roof 81, and to bars 24, 44 of lateral walls 21, 41.

Door 22 may now be connected to pivot arm 16 of the door-actuating device. Finally, suspension 101 may be bolted to the ends of tension bars 28, 48 projecting beyond roof 81. Sensing arm 104 must still be connected, with Bowden cable 103, to the door actuating device, which is also achieved by screwed connections. Finally the passenger seats are installed.

Thus assembly of the box constituting the actual cabin requires merely tightening a few bolts and inserting transparent sheet 71 into resilient strips 72. None of the parts transported to the site require welding. Even the connection between the door-actuating device, the door and the sensing arm on the suspension are all plug-in and screwed connections. The parts of the cabin may thus be assembled with simple tools, at the site of the funicular railway, by persons with no special technical knowledge.

The edges of lateral wall 41 consist of a closed frame made of bars comprising longitudinal grooves. The bars forming the edges of lateral wall 21, and also comprising longitudinal grooves, have a break only at the door opening, and thus almost form a closed frame.

When bars 82 of the roof frame are bolted to bar 25 of lateral wall 21, and to the corresponding bar of lateral wall 41, longitudinal ribs **82*c* on bars 82 engage in the longitudinal grooves in the two bars of the lateral walls. Longitudinal ribs 66*c* on bars 66 of end-walls 61 engage in longitudinal grooves 24*d* as bars 24, and in corresponding grooves 24*d* in bars 44**. The longitudinal ribs on angle-pieces also engage in the longitudinal grooves in the bars bolted to them. The trapezoidal ribs and grooves of the various bars screwed together in pairs have a centering action and thus facilitate the bolting together.

The sides of the complementary ribs and grooves which engage with each other, bear against each other, and thus provide positive joints at right angles to their length and to the axes of the relevant bolts 68, 85. Thus vertical forces occurring between lateral walls 21, 41 and roof 81 are transferred by the relevant bars by the said sides of the ribs and grooves. In a similar manner, forces in the direction of travel, arising between lateral walls 21, 41 and end-walls 61, are largely transferred by the curved sides of the ribs and grooves engaging with each other. Since bars 26, 44, 66 are curved along planes running parallel with lateral walls 21, 41, the sides of the said ribs and grooves naturally do not lie in one plane but are curved. The result of this is that sides of the longitudinal ribs engaging in the longitudinal grooves can transfer, at least partly, not only horizontal, but also all forces acting approximately parallel with lateral walls 21, 41. The joints obtained are therefore highly stable, and bolts 68, 85, by means of which adjacent bars are held together, are not stressed in shear.

It should also be noted that bolted joints may also be provided with locking means, not shown, such as circlips and spring washers.

In the example of embodiment illustrated in the drawing, end-walls 61 are so curved that the central portions thereof project outwardly in a vertical section, i.e. when the direction of viewing is at right angles to lateral walls 21, 41. However, instead of a constant curve, the said end-walls may be angled, with the apex of the angle projecting outwardly. In this case, a view of the cabin corresponding to that in FIG. 1 would be approximately hexagonal in outline. Moreover, the said end-walls could also be vertical.

The design and attachment of the suspension may also be varied in several ways. For instance, base 105 may be arranged under the cabin roof.

The embodiments of the invention in which an exclusive property or privilege is claimed are as follows:

1. A cabin for a funicular railway, said cabin comprising a floor, two lateral walls facing each other, at least one of which has a door opening, two end-walls facing each other, and a roof, characterized in that the said floor, walls and roof are connected detachably to each other, at least a part of the roof and walls are secured together by fastening means, in that at least those edges of the lateral walls and of the end walls, which are adjacent to one another, are formed at least in part by bars which extend along each other in pairs, bear upon each other, and are fastened together by said fastening means passing through one of the bars and in that one of each of these pairs of adjacent bars thus fastened together has a longitudinal rib, while another bar has a longitudinal groove with which said rib engages, and that sides of longitudinal grooves taper towards their bottoms so that sides of said longitudinal ribs bear upon sides of said longitudinal grooves.

2. A cabin according to claim 1, characterized in that the bars, constituting the lateral edges and the upper edges of the lateral walls, are provided with longitudinal grooves, and in that the bottoms of the grooves in these bars run parallel to the plane formed by the lateral walls.

3. A cabin according to claim 1, characterized in that the lateral walls are vertical, flat and parallel with the direction of travel; and in that a central area of each end-wall projects outwardly, as seen at right angles to the lateral walls.

4. A cabin according to claim 1, characterized in that said fastening means pass through one bar of a pair of said bars and are fastened into inside thread means rigidly secured to another bar of said pair of bars.

5. A cabin according to claim 1, characterized in that the adjacent edges of the two lateral walls and the roof are formed by bars extending along each other in pairs.

6. A cabin according to claims 1 or 5, characterized in that said bars forming said edges are fixed to the walls of which they form the edge.

7. A cabin according to claim 1, characterized in that a bar comprising a longitudinal rib that has two legs approximately at right angles to each other, one of them being provided externally with the longitudinal rib; in that the bar having the longitudinal groove comprises a longitudinal aperture defined by three section-walls; in that two of the section-walls, one of which has a longitudinal groove, form with each other a right angle; and in that the third section-wall forms an arc extending over a central right angle.

8. A cabin according to claim 7, characterized in that the bar having the longitudinal groove comprises, at least on one side of the arcuate section-wall, a projecting flange tangential thereto and extending over at least a part of said bar length.

9. A cabin according to claim 1, characterized in that each lateral wall comprises two bars running continuously from the floor to the roof and constituting edges of said lateral walls, a bar, forming upper edge of the lateral wall being welded to upper ends of said bars; in that the roof comprises four bars welded together in pairs at their ends and forming a roof frame; and in that two of the bars, pertaining to said roof-frame, bear upon the upper edges of the bars forming the upper edges of the lateral walls, and are bolted thereto.

10. A cabin according to claim 9, characterized in that each end-wall comprises a profiled section, constituting a lower edge, to which are welded two profiled sections forming the lower part of the lateral edges of the end-wall, said profiled sections bearing upon the bars forming the side edges of the lateral walls and being bolted thereto; in that the lateral walls, in the area above the profiled sections forming the lateral edges of the end-walls, and the bars of the roof-frame located above the said end-walls, comprising a flange running parallel with the relevant end-wall and extending towards it; and in that each end-wall comprises a transparent sheet, edges of which are secured detachably, by means of a push-in strip, to said flanges of the bars, of the lateral walls, and to a part of said end-wall located under said transparent sheet.

* * * * *